US005146882A

United States Patent [19]

Brinkman et al.

[11] Patent Number: 5,146,882

[45] Date of Patent: Sep. 15, 1992

[54] METHOD AND APPARATUS FOR COLD STARTING A SPARK IGNITED INTERNAL COMBUSTION ENGINE FUELED WITH AN ALCOHOL-BASED FUEL MIXTURE

[75] Inventors: Norman D. Brinkman, Troy; Cameron J. Dasch, Bloomfield Hills, both of Mich.; Lynn A. Rockwell, Anderson; Daniel H. Hopper, Peru, both of Ind.

[73] Assignees: General Motors Corporation, Detroit, Mich.; Delco Electronics Corporation, Kokomo, Ind.

[21] Appl. No.: 750,357

[22] Filed: Aug. 27, 1991

[51] Int. Cl.[5] ..... F02D 43/00; F02D 41/06

[52] U.S. Cl. ..... 123/179.5; 123/1 A; 123/179.16; 123/491; 123/634

[58] Field of Search ..... 123/179.5, 179.16, 179.17, 123/1 A, 491, 634

[56] References Cited

U.S. PATENT DOCUMENTS

| | | | |
|---|---|---|---|
| 3,972,315 | 8/1976 | Munden et al. | 123/604 |
| 4,703,732 | 11/1987 | Wineland et al. | 123/1 A |
| 4,706,630 | 11/1987 | Wineland et al. | 123/1 A |
| 4,711,226 | 12/1987 | Neuhalfen et al. | 123/609 |
| 4,750,467 | 6/1988 | Neuhalfen | 123/644 |
| 4,893,105 | 1/1990 | Maeda et al. | 123/634 |
| 4,915,084 | 4/1990 | Gonze | 123/575 |
| 4,971,051 | 11/1990 | Gonze | 123/494 |

OTHER PUBLICATIONS

"Capacitive Discharge/Inductive Ignition System," disclosed by Daniel H. Hopper, Research Disclosure No. 28035, Aug. 1987.

"Cold Starts Using M-85 (85% Methanol): Coping with Low Fuel Volatility and Spark Plug Wetting," C. J. Dasch, N. H. Brinkman, and D. H. Hopper, SAE Paper No. 910865, 1991. (Feb. 25-Mar. 1).

*Primary Examiner*—Andrew M. Dolinar

*Attorney, Agent, or Firm*—Jimmy L. Funke

[57] ABSTRACT

A method and apparatus for enhancing the cold starting performance of a spark ignition, internal combustion engine fueled with an alcohol-based fuel mixture is described. The quantity of fuel mixture delivered to the engine is regulated to establish a combustible fuel vapor-air mixture in each engine cylinder during cranking, while restricting the accumulation of unvaporized fuel in the each cylinder so as not to exceed a predetermined amount. In addition, each cylinder spark plug is provided with an ignition current having a peak magnitude sufficient to achieve voltage break down across each spark plug arc gap, when each gap is resistively loaded due to wetting in accordance with the predetermined amount of accumulated unvaporized fuel. Preferably, the quantity of fuel delivered to the engine during cranking is reduced at a substantially exponential rate as a function of the cumulative number of revolutions the engine is rotated during cranking. An ignition coil having a secondary to primary winding turns ratio in the order of 65:1, with its secondary winding wrapped onto a plurality of partitions in a segmented dielectric bobbin, is employed to provide the required ignition current for firing the engine spark plugs when the predetermined amount of unvaporized fuel accumulates in the engine cylinders.

21 Claims, 6 Drawing Sheets

METHOD AND APPARATUS FOR COLD STARTING A SPARK IGNITED INTERNAL COMBUSTION ENGINE FUELED WITH AN ALCOHOL-BASED FUEL MIXTURE

BACKGROUND OF THE INVENTION

This invention relates to a method and apparatus for cold starting an engine, and more particularly, to a method and apparatus for enhancing the cold starting capability of a spark ignition, internal combustion engine, which is fueled with an alcohol-based fuel mixture.

In the past, alcohol fuels, such as ethanol and methanol, have been proposed as possible alternatives to gasoline for fueling conventional internal combustion engines. It is well known that engines using these alternative fuels generally can not be started at low ambient temperatures, due to the higher heats of vaporization, lower vapor pressures, and the higher fuel concentrations required to achieve stoichiometric fuel-air mixtures for alcohol fuels.

To successfully cold start a spark ignition engine, a sufficient amount of fuel must be vaporized to provide a combustible fuel vapor-air mixture in the vicinity of each engine spark plug. However, attempts to achieve a combustible fuel vapor-air mixture by increasing the flow of an alcohol fuel during cold starting have been unsuccessful, due to the occurrence of repeated engine misfires.

Various approaches have been heretofore suggested for improving the cold starting capability of alcohol fueled engines, including the use of fuel preheaters to assist fuel vaporization and additional fuel injectors for injecting fuel in two-stages to increase the flammability of cylinder fuel vapor-air mixtures. Although these approaches have shown some success, they require that conventional engines be augmented with complex and costly fuel preheaters or auxiliary fuel injection systems.

It is also known that a small quantity of gasoline can be mixed with methanol or ethanol to increase the fuel vapor pressure, and thereby improve engine cold-starting and warm-up operation. One example of an alcohol-based fuel that is gaining popularity as a commercially feasible automobile fuel is commonly known as M-85. This fuel is formed by mixing 15% gasoline with 85% methanol. Testing has shown that conventional engines generally can not be started at ambient temperatures below −20° C. with the M-85 fuel, which is still significantly higher than a desired minimum cold starting temperature of −29° C., that is a commonly used standard for automobiles.

Consequently, there exists a need for a convenient method and apparatus for improving the cold starting performance of a spark ignition, internal combustion engine at low ambient temperatures, when the engine is fueled with an alcohol-based fuel mixture.

SUMMARY OF THE INVENTION

It is the general object of the present invention to provide a method and apparatus for enhancing the cold starting performance of a spark ignition, internal combustion engine operating on an alcohol-based fuel mixture. To successfully cold start such an engine at low ambient temperatures, a sufficient quantity of fuel must be delivered to establish a combustible fuel vapor-air mixture in the vicinity of each engine spark plug, without causing subsequent cylinder misfires The Applicants have recognized that cylinder misfiring in engine fuel with alcohol-based mixtures is due in part to the electrically conductive nature of the alcohol-based fuels, which resistively loads wetted spark plug arc gaps. When the quantity of fuel delivered to the engine is increased in a conventional fashion to establish a combustible fuel vapor-air mixture in the engine cylinders at a low ambient temperature, the amount of unvaporized fuel accumulating in the engine cylinders also increases. As the amount of unvaporized fuel increases, it has been found that the resistance shunting each wetted spark plug arc gap decreases in value. Eventually, the magnitude of the peak ignition current supplied to each cylinder spark plug is not sufficient to achieve the break down voltage of the arc gaps and ignite the vaporized fuel. Consequently, the engine misfires and starting is prevented.

Based upon the above realization, it was found that the cold starting performance of an engine operating on an alcohol-based fuel mixture could be significantly enhanced at low ambient temperatures by regulating the quantity of fuel mixture delivered to the engine during cranking to establish a combustible fuel vapor-air mixture in each cylinder, while restricting the accumulation of unvaporized fuel in each engine cylinder so as not to exceed a predetermined amount, and providing each cylinder spark plug with an ignition current having a peak magnitude sufficient to effectuate voltage break down across each arc gap, when each arc gap is resistively loaded due to wetting in accordance with the predetermined amount of accumulated unvaporized fuel.

More specifically, for an engine fueled with an alcohol-gasoline mixture, where the engine includes cranking means for rotating the engine during starting, means for delivering fuel to each engine cylinder, and a spark plug with an arc gap position in each cylinder for igniting the delivered fuel, the engine cold starting performance is enhanced by (1) deriving an indication of the engine temperature; (2) deriving an indication of the relative proportion of alcohol to gasoline in the fuel mixture; (3) deriving an indication of the cumulative number of engine revolutions during cranking; (4) delivering a scheduled quantity of fuel to the engine, as the engine is cranked for starting, where the scheduled quantity of fuel is determined as a function of the derived indications for the engine temperature, the relative proportion of alcohol to gasoline in the fuel mixture, and the cumulative number of cranking engine revolutions, so as to establish a combustible fuel vapor-air mixture in each engine cylinder, while restricting the accumulation of unvaporized fuel in each cylinder so as not to exceed a predetermined amount; and (5) providing each cylinder spark plug with an ignition current having a peak magnitude sufficient to effectuate voltage break down across each spark plug arc gap, when each arc gap is resistively loaded due to wetting in accordance with the predetermined amount of accumulated unvaporized fuel.

Preferably, the quantity of fuel initially delivered to the engine at the start of cranking is determined as a function of the derived indications for the engine temperature and the relative proportion of alcohol to gasoline in the fuel mixture, and thereafter, the quantity of delivered fuel is reduced during cranking to effectuate a delivered fuel-air ratio that decreases at a substantially exponential rate as a function of the cumulative number of cranking revolutions of the engine. More specifically, a 20% reduction in the injected fuel-air ratio for every engine cycle during cranking (or every two revolutions of the crankshaft in a four-stroke engine) was found to be optimum, in that it enabled the largest quantity of fuel to be delivered at the initiation of cranking, without producing subsequent cylinder misfires. Consequently, a combustible fuel vapor-air mixture is rapidly established in the engine cylinders to provide fast first firing during starting.

A modified ignition coil having a secondary to primary winding turns ratio in the order of 65:1 and having its secondary winding wrapped onto a plurality of partitions in a segmented dielectric bobbin was utilized to increase the peak ignition current provided to each cylinder spark plug. This coil was found to provide a peak ignition current in excess of 100 mA, which is sufficient to fire typical spark plugs having shunting resistances as low as 200 kΩ across their arc gaps due to wetting by unvaporized fuel in the engine cylinders.

Utilizing the principles of the present invention, spark ignition, internal combustion engines operated on a methanol fuel mixture known as M-85(HVG) have been successfully started at ambient temperatures as low as —29° C., in less than 10 seconds after the initiation of cranking. The M-85(HVG) fuel is formed by mixing 85% methanol with 15% high volatility gasoline having a Reid Vapor Pressure (RVP) of 14. Previously, it has not been possible to start engines using this fuel at temperatures below −20° C., without employing fuel preheating, auxiliary fuel injectors, or other costly measures to improve fuel volatility at the low starting temperatures.

These and other aspects and advantages of the invention may be best understood by reference to the following detailed description of the preferred embodiments when considered in conjunction with the accompanying drawings.

DESCRIPTION OF THE PREFERRED EMBODIMENTS

Figure 1:
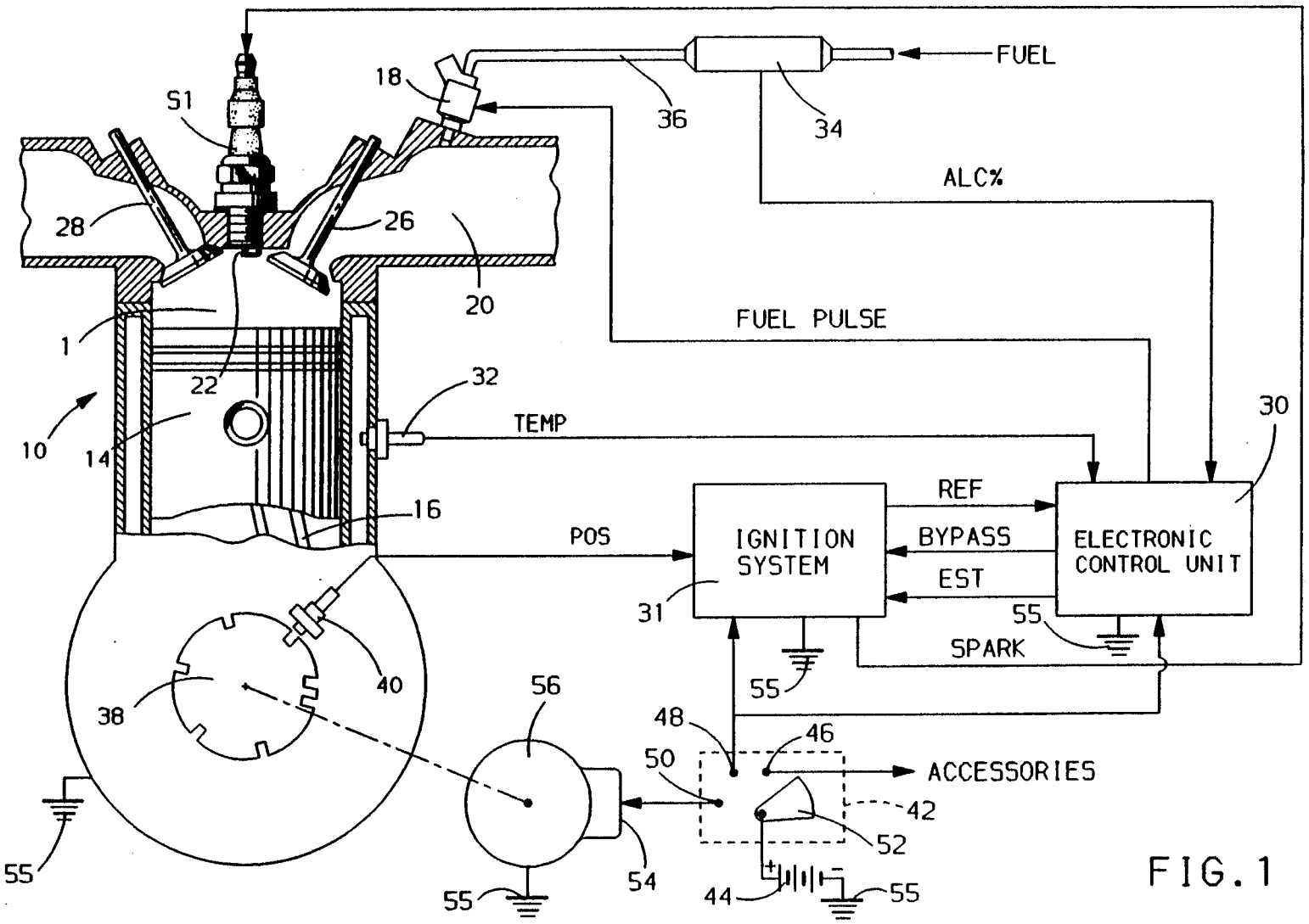
FIG. 1 schematically illustrates an internal combustion engine, which is operated on an alcohol-based fuel mixture, and the associated ignition and computer control systems, which include the present invention for improving engine cold starting performance.

Referring now to the drawings, and in particular to FIG. 1, there is shown schematically an internal combustion engine, generally designated as 10, which is fueled with an alcohol-based fuel mixture. A portion of the exterior of engine 10 has been removed to expose a cylinder denoted by the numeral 1. Piston 14 resides within the wall of cylinder 1, with rod 16 connecting piston 14 to a rotatable engine crankshaft (not shown). A solenoid driven fuel injector 18 projects into an intake port 20 for delivering fuel to the associated cylinder 1. Cylinder 1 is additionally provided with a spark plug S1, which has an arc gap 22 for igniting fuel delivered to the cylinder 1. Also shown are intake valve 26 and exhaust valve 28, which are opened and closed in timed relationship with the rotation of the engine crankshaft to enable the intake of fuel into cylinder 1 and the exhaust of burned fuel components after combustion. It should be noted that engine 10 is preferably a multi-cylinder engine, even though only a single cylinder 1 is illustrated in FIG. 1 to simplify the description.

The operation of engine 10 is controlled by a conventional electronic computer control system, which includes an electronic control unit (ECU) 30, an electronic ignition system 31, and several standard sensors that provide information related to the engine operating conditions.

The ECU 30 is a conventional digital computer used by those skilled in the art of engine control, and includes the standard elements of a central processing unit, random access memory, read only memory, non-volatile memory, analog-to-digital converter, input/output circuitry, and clock circuitry.

A standard coolant temperature sensor 32 provides the ECU 30 with a TEMP input signal, which is indicative of the temperature within engine 10 (and also, the ambient temperature when the engine is cold started). The ECU 30 is also provided with a fuel composition input signal ALC %, which indicates the composition of the alcohol-based fuel delivered to engine 10. The ALC % input signal is obtained from a fuel composition sensor 34, which is positioned close to engine 10, in a fuel supply line 36 communicating with fuel injector 18. The fuel composition sensor can be of any known type, such as a capacitive dielectric sensor described in U.S. Pat. Nos. 4,915,084 and 4,971,051, which to E. V. Gonze on Apr. 10, 1990 and Nov. 20, 1990, respectively, and have been assigned to the assignee of the present application. This capacitive sensor measures the dielectric constant of the fuel delivered to engine 10, and generates a signal corresponding to the relative proportion of alcohol to gasoline in the fuel mixture.

The ignition system 31 illustrated in FIG. 1 is a direct ignition system (DIS), which does not include a distributor. Such systems are known in the automotive art, see for example U.S. Pat. Nos. 4,711,226 and 4,750,467, which respectively issued to Neuhalfen et al on Dec. 8, 1987 and Neuhalfen on Jun. 14, 1988, and which have been assigned to the assignee of the present application. As will be discussed at a later point in the specification, the DIS system typically contains a DIS electronic ignition module and separate inductive ignition coils for each pair of cylinders present in engine 10.

The ignition system 31 is provided with an input signal POS indicating the rotational position of the engine crankshaft. The POS signal may be obtained from a standard rotational sensor such as slotted wheel and electromagnetic sensor 40. The slotted wheel 38 is mechanically coupled to the engine crankshaft, and contains six equally spaced slots, with one additional asymmetrically spaced slot for synchronization. As wheel 38 is rotated by the crankshaft, the electromagnetic sensor 40 detects the passage of the slots and generates corresponding pulses in the POS input signal.

A conventional ignition switch 42 is used to start and run engine 10. The ignition switch 42 has three stationary contacts 46, 48, and 50, with a manually movable contact 52. As shown, movable contact 52 is positioned in the open position, but can be rotated to a "crank" position, where it simultaneously bridge stationary contacts 50 and 48, or to a "run" position, where it bridges contacts 46 and 48.

As ignition switch 42 is rotated to the crank position, the voltage potential of battery 44 is applied to stationary contacts 48 and 50 to energize the ECU 30, the ignition system 31, and a starter solenoid 54. Electric currents flow from battery 44 through the leads illustrated in FIG. 1, and return to the battery 44 through ground points, which are illustrated throughout the system by the accepted schematic symbol and referenced by the numeral 55. When the starter solenoid 54 is energized, a starter motor 56 and the engine crankshaft are engaged in the customary fashion, and the starter motor 56 then cranks or rotates engine 10 for starting.

The movable contact 52 of ignition switch 42 is normally spring biased to return to the run position, after the engine is running and the movable contact 52 is released. In the run position the potential of battery 44 continues to be applied to the ignition system 31 and the ECU 30 through contact 48, and to any accessory circuits connected to contact 46.

When the crankshaft of engine 10 is first cranked for starting by the starter motor 56, the passage of slots in wheel 38 are detected by sensor 40, which generates corresponding pulses in the POS input signal directed to the ignition system 31. As the ignition system 31 detects the first occurrence of the synchronization pulse from the asymmetrically spaced slot on wheel 38, a REF input signal to the ECU 30 is switched from a low to a high state. Thereafter, during the remainder of the cranking period and when the engine 10 is running, the REF input is toggled to change states (switched from low-to-high or high-to-low), only when one of the six equally spaced slots on wheel 38 is detected. Thus, after the detection of the first synchronization pulse, the REF input signal contains three pulses per revolution of the engine, with the rising and falling edges of each pulse corresponding to the detection of one of the six equally spaced slots on wheel 38.

In a conventional manner, the ECU 30 utilizes the reference pulses provided by the synchronized REF input to determine the rotational speed and crankshaft engine 10, the ECU 30 computes fuel injection and spark timing information, as well as the appropriate quantity of alcohol-based fuel to supply to engine 10 (see for example, U.S. Pat. No 4,915,084 issued to Gonze on Apr. 10, 1990, and assigned to the same assignee of the present application). Based on this computed information, the ECU 30 outputs a timed FUEL PULSE to the solenoid of fuel injector 18, where the width of the FUEL PULSE is proportional to the quantity of fuel sprayed into intake port 20 by fuel injector 18.

During normal engine running, ECU 30 provides the ignition system 31 with a conventional spark advance signal EST to properly time the SPARK energy delivered to the spark plug S2. However, when the engine is cranked to start and/or the engine speed is below a predetermined speed (for example, 400 RPM), the ignition system 31 is operated in a bypass mode. Operation in this mode is indicated by the BYPASS signal provided by the ECU 30. During bypass operation, the ignition timing is determined by the ignition system 31 alone, without the use of the EST signal.

Figure 2:
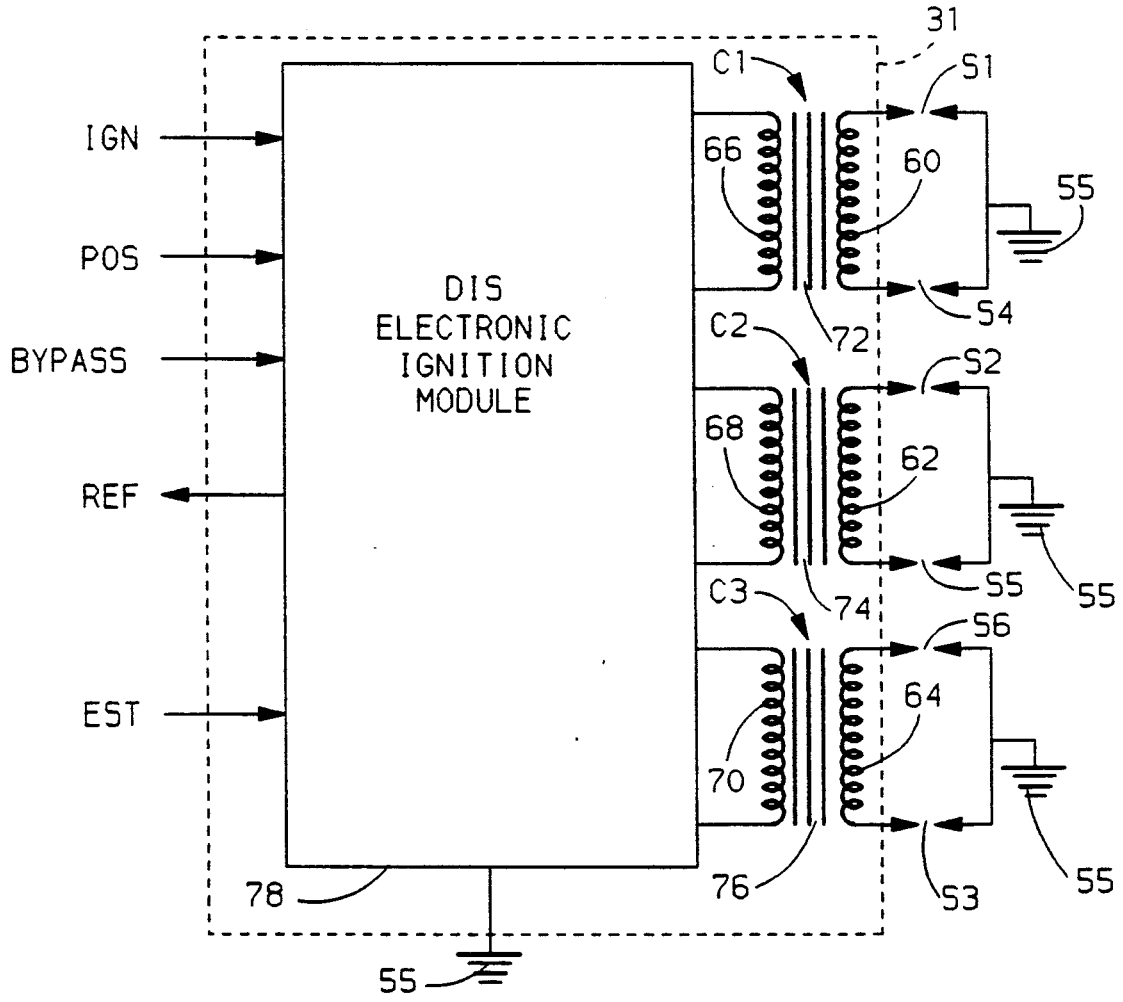
FIG. 2 schematically illustrates components included within a conventional direct ignition system.

Referring now to FIG. 2, there is shown a more detailed schematic representation of the components present in the conventional direct ignition system (DIS) 31, which for the purpose of the present description is configured for operation with an engine 10 having six-cylinders designated respectively by the numerals 1–6. The cylinder firing order for engine 10 will be considered as 1-2-3-4-5-6, where the pair of pistons in cylinders 1 and 4 each reach top dead center (TDC) simultaneously (one at top of its compression stroke, the other at the top of its exhaust stroke), and likewise for the pair of pistons in cylinders 2 and 5, and the pair in cylinders 3 and 6.

The spark plugs associated with cylinders 1–6 are designated as S1–S6, respectively, and are represented by the standard double arrowed gap symbols shown in FIG. 2.

As stated previously, the direct ignition system 31 is a distributorless ignition system in that it does not utilize a rotor and distributor cap contacts for sequentially distributing spark firing energy to the engine spark plugs. Instead, each pair of engine cylinders, for which TDC occurs simultaneously, has a separate ignition coil for their associated spark plugs. To this end, spark plugs S1 and S4 are shown connected to the secondary winding 60 of ignition coil C1; spark plugs S2 and S5 are connected to the secondary winding 62 of ignition coil C2; and spark plugs S3 and S6 are connected to the secondary winding 64 of ignition Coil C3. In addition, ignition coils C1, C2, and C3 have primary windings 66, 68, and 70, respectively, that are electromagnetically linked to their corresponding secondary windings through ferromagnetic cores 72, 74, and 76. Each side of the primary windings 66, 68, and 70 are connected to a DIS electronic ignition module 78. The DIS ignition module 78 and ignition coils C1, C2, and C3, such as described above, have been commercially available since 1987 as components in conventional direct ignition systems for 2.8 and 3.1 liter engines in vehicles, such as the Chevrolet Celebrity, produced and sold by General Motors Corporation.

The DIS electronic ignition module 78 includes semiconductor switches (typically transistors that are not shown) for controlling the current flowing through the primary windings of the ignition coils C1, C2, and C3. As is well known, each primary winding is connected in series with a separate semiconductor switch and the voltage potential provided to ignition system 31 by the battery 44. Each semiconductor switch is normally biased to establish a predetermined current flow through each ignition coil primary winding (for example, 8.5 amperes in the preferred embodiment).

In accordance with the spark timing information, the DIS electronic ignition module 78 opens each semiconductor switch, at the appropriate time during the engine cycle, to interrupt the established current flowing through the primary winding in each of the ignition coil C1–C3. When the current flow through a primary winding 66, 68, or 70 is interrupted, the corresponding magnetic field established in the respective ferromagnetic core 72, 4, or 76 collapses, which in turn induces an ignition current in the secondary winding 60, 62, or 64 of the respective ignition coil. In a conventional direct ignition system (DIS) the coils C1, C2, and C3 are designed to produce a secondary ignition current having a peak magnitude in the range of 50 to 60 mA. A peak ignition current in this range is generally sufficient to achieve the arc gap breakdown voltage for spark plugs in conventional gasoline fueled engines, unless the arc gaps are carbon fouled.

Those skilled in the art will recognize that the peak ignition current provided by the secondary winding of an inductive ignition system (such as the DIS) is given approximately by the maximum primary current divided by the secondary to primary turns ratio for the windings of the ignition coil. As used in the present specification and accompanying claims, this peak ignition current is not meant to include the transitory current spikes that generally are associated with the electrical breakdown of a spark plug arc gap. As is known, the peak ignition current can be measured without these transient current spikes by replacing the spark plug loading the secondary winding of an ignition coil with a series of Zener diodes having a combined break down voltage in the order of 800 volts.

As is customary in a direct ignition system, the secondary winding of each coil C1, C2, and C3 is connected in series with a different pair of spark plugs as shown in FIG. 2. The circuitry within the DIS electronic ignition module 78 appropriately times the interruption of current through the primary winding of each ignition coil so that each pair of spark plugs are fired simultaneously, while one of the associated cylinders is in the compression stroke and the other is in the exhaust stroke, and vice versa. As a result, each pair of spark plugs is fired once during every complete revolution of the engine, or twice during an engine cycle in a four-stroke engine.

As stated previously in the specification, one of the major problems associated with fueling engine 10 with an alcohol-based fuel is the inability to start the engine at low ambient temperatures. To successfully cold start a spark ignition engine, a sufficient amount of fuel must be vaporized to provide a combustible fuel vapor-air mixture in the vicinity of each engine spark plug. However, past attempts to achieve such a combustible fuel vapor-air mixture by increasing the quantity of alcohol-based fuel delivered to the engine during cold starting have been unsuccessful, due to repeated engine misfires.

Engine misfires result when spark plug arc gaps are wetted by the unvaporized portion of an alcohol-based fuel that accumulates in the engine cylinders. The Applicants have recognized that alcohol-based fuels have an electrical conductivity significantly larger than that of conventional gasoline (7 to 9 orders of magnitude), which is due to the relatively high concentration of dissolved ions made possible by the large dipole moments of alcohol-based fuels. Due to the conductive nature of alcohol-based fuels, the wetting of spark plugs produces resistive loading across the spark plug arc gaps. As the quantity of fuel delivered to the engine is increased to establish a combustible fuel vapor-air mixture in the engine cylinders at a low ambient temperature, the amount of unvaporized liquid fuel accumulating in the engine cylinders also increases. It has been found that as the amount of unvaporized fuel increases, the magnitude of the resistance shunting each spark plug arc gap decreases. Eventually the magnitude of the peak ignition current supplied to fire the spark plugs is no longer sufficient to achieve voltage break down across the spark plug arc gaps due to the decreased value of the shunting resistances. Consequently, the engine misfires and starting is prevented.

Based upon the above realization, it was found that the cold starting performance of an engine operating on alcohol-based fuel mixture could be significantly enhanced by regulating the quantity of fuel mixture delivered to the engine during cranking to establish a combustible fuel vapor-air mixture in each cylinder, while restricting the accumulation of unvaporized fuel in each engine cylinder so as not to exceed a predetermined amount, and providing each cylinder spark plug with an ignition current having a peak magnitude sufficient to effectuate voltage break down across each arc gap, when each arc gap is resistively loaded due to wetting in accordance with the predetermined amount of accumulated unvaporized fuel.

To more explicitly describe the method and apparatus for carrying out the present invention, a fuel known as M-85(HVG) will be used as an example of an alcohol-based fuel in the remainder of the specification. This fuel is formed by mixing 85% methanol with 15% high volatility gasoline having a Reid Vapor Pressure (RVP) of 14 psi. The small quantity of gasoline added to the methanol increases the vapor pressure of the fuel mixture, and enables conventional engines operating on this fuel to be started at ambient temperatures down to approximately −20° C. This is still significantly higher than the which is a commonly used at the desired standard for automobiles.

As will be recognized by those skilled in the art, the present invention is applicable to alcohol-based fuels in general, and the use of the specific M-85(HVG) fuel for the purpose of explanation should not be considered to limit the invention in any way to this particular alcohol-based fuel.

Experimental measurements performed by the Applicants have shown that resistances in the order of 200 kΩ appear in shunt across spark plug arc gaps that are wetted with M-85(HVG) fuel during engine cranking, when the fuel is delivered in accordance with an optimized schedule to quickly establish a combustible fuel vapor-air mixture in each cylinder at an ambient temperature of −29° C., while restricting the amount of unvaporized fuel that accumulates in the cylinders. The method and apparatus for achieving this optimized schedule for delivering fuel will be described more fully at a later point in the specification.

Typical break down voltages for spark plug arc gaps are in the range of 15 to 20 kV (for arc gaps of approximately 0.040 inches). The magnitude of the peak ignition current, represented by $I_s$, needed to overcome a shunt resistance of $R_s$ across a spark plug arc gap with a break down voltage of $V_{bd}$, is provided by the following expression:

$$I_s > V_{bd}/R_s.$$

In view of the foregoing, the magnitude of the peak ignition current must be greater than 100 mA to prevent engine misfires, and ensure the starting of an engine optimally fueled with M-85(HVG) at temperatures down to −29° C. As stated previously, conventional high energy ignition systems provide peak ignition currents in the range of 50 to 60 mA, which is not sufficient to achieve the spark plug arc gap break down voltage under these conditions. Although the above expression predicts that a peak ignition current of greater than 100 mA will be required to start an engine that is fueled with M-85(HVG) at −29° C., it will be recognized that different peak ignition currents will be required for starting engines operating on different alcohol-based fuel mixtures at different ambient temperatures. In any case, increasing the peak ignition current above the conventional level of 50 to 60 mA will improve engine cold starting performance (i.e., enable starting at lower ambient temperatures), since larger amounts of fuel can then be delivered to the engine to increase the fuel vapor-air ratio without causing engine misfires.

Several known techniques exist for increasing the magnitude of the peak ignition current supplied to the engine spark plugs. For example, a hybrid ignition system having combined inductive and capacitive discharge portions, such as disclosed in Research Disclosure, "Capacitive Discharge/Inductive Ignition System," No. 28035, August 1987, and in U.S. Pat. No. 3,972,315 issued to Munden et al. on Aug. 3, 1976, which is hereby incorporated by reference, has also been found to improve the cold starting performance of engines operating on M-85(HVG) fuels (see the publication "Cold Starts Using M-85 (85% Methanol): Coping with Low Fuel Volatility and Spark Plug Wetting," C. J. Dasch, N. D. Brinkman, and D. H. Hopper, SAE Paper No. 910865, 1991). Alternatively, capacitive discharge ignition systems or any other known ignition system that is capable of increasing peak ignition current could be used to enhance the cold starting performance in accordance with the present invention.

It will be understood by those skilled in the art that in order to preclude misfires and partial burns, the ignition system must also be designed to comply with other minimal requirements, in addition to providing increased peak ignition current. For example, the minimum energy delivered to each spark plug should be greater than approximately 12 mJ, and the spark duration should be longer than approximately 50 microseconds (or alternatively, multiple, closely spaced sparks could be provided.

For the preferred embodiment of the present invention, it was found that ignition coils of the conventional direct ignition system 31 (see FIG. 2) could be modified to provide peak ignition currents in excess of 100 mA to the engine spark plugs, while satisfying the other requirements related to spark duration and energy. This proved to be a cost effective approach, since the other components of the conventional direct ignition system 31 required no changes, and this particular direct ignition system was known to be highly reliable.

Figure 3:
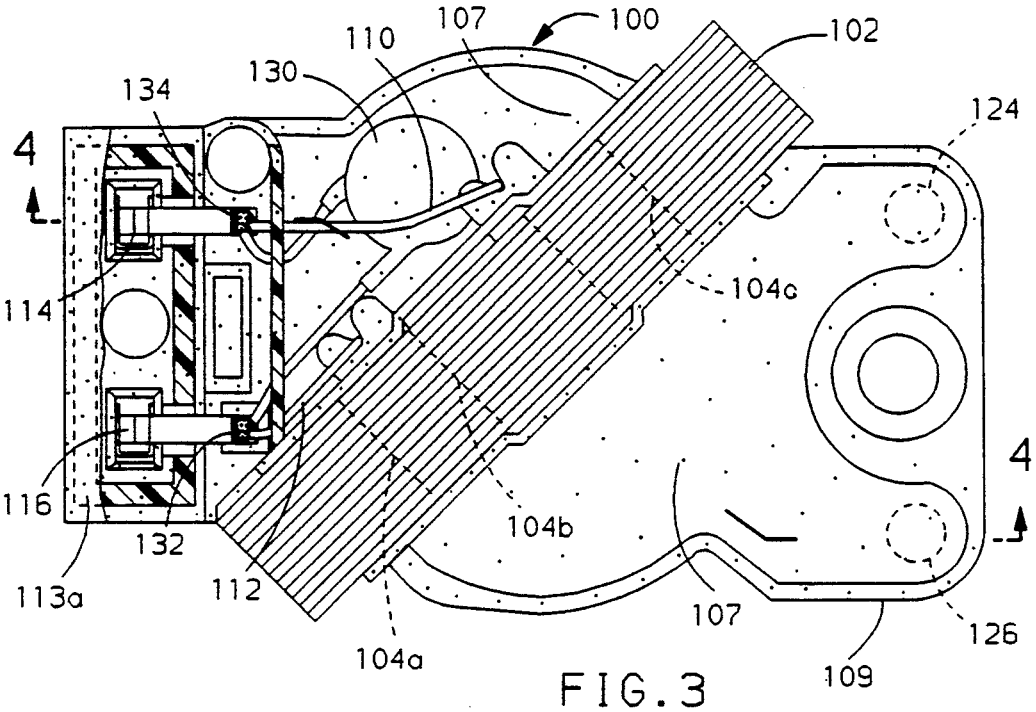
FIG. 3 illustrates a top plan view of a modified ignition coil for the direct ignition system utilized in the preferred embodiment of the present invention.
Figure 4:
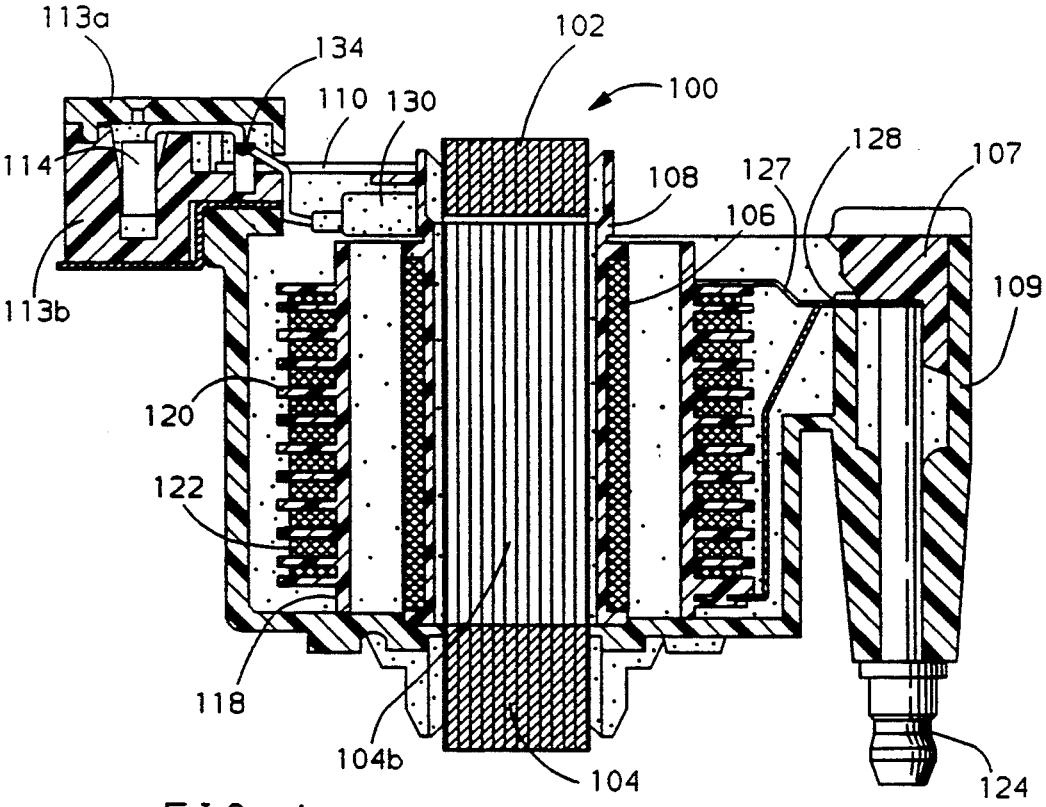
FIG. 4 shows a sectional elevation view of the modified ignition coil of FIG. 3 taken along the line A—A.

Referring now to FIGS. 3 and 4, the modifications made to each of the ignition coils C1, C2, and C3, for increasing the peak ignition current provided by the direct ignition system 31 will now be described. FIG. 3 shows a top plan view of a modified ignition coil, generally designated as 100, while FIG. 4 shows a sectional elevation view through the modified ignition coil 100, taken through the line A—A in FIG. 3.

The modified ignition coil 100 includes a standard laminated ferromagnetic core having an upper rectangular member 102 contacting a lower E-shaped member 104. The lower E-shaped member 104 has its two outer legs **104*a* and 104*c*, and central leg 104*b* extending upwardly, as indicated by the dotted lines designating the hidden surfaces A primary winding 106 of approximately 90 turns is continuously wrapped around a primary winding tube 108, which in then inserted over the central leg 104*b* of the E-shaped ferromagnetic core member 104**.

In the conventional DIS ignition coils C1, C2, and C3, a secondary winding of approximately 8100 turns would normally be wound in a continuous fashion on a secondary bobbin to achieve a secondary to primary turns ratio of approximately 90:1, which is typical in conventional direct ignition systems. The continuously wound secondary bobbin would then be positioned concentrically around the primary winding tube 108 and the central leg **104*b*** of the ferromagnetic core.

In the modified coil 100, the conventional continuously wound secondary bobbin is replaced with a segmented secondary bobbin 118 having a generally tubular cylindrical form that is axially segmented (or divided) into partitions by a series of annular flanges 120 extending in an outward radial direction. The segmented secondary bobbin 118 is preferably molded from a material having a high dielectric constant such polyphenylene oxide. In the preferred embodiment, the segmented secondary bobbin 118 is molded to directly replace the conventional continuous wound secondary bobbin to simplify the manufacture of the modified coil.

As illustrated in FIG. 4, the segmented secondary bobbin contains 11 partitions, for receiving turns of wire for the secondary winding 122 of the modified ignition coil 100. The secondary winding 122 is formed on the segmented secondary bobbin 118, by wrapping a predetermined number of turns into each partition, starting from one end and proceeding to each adjacent partition until reaching the opposite end of the segmented bobbin 118. A small slot may be provided in each flange 120 for passing the secondary wire from one partition to the next.

In the preferred embodiment, the two end partitions receive approximately 293 turns, while each of the inner partitions receive approximately 585 turns. Consequently, the secondary winding 122 has approximately 5851 turns, giving the modified ignition coil 110 a secondary to primary turns ratio of 65:1.

The primary winding tube 108, segmented secondary bobbin 118, and the ferromagnetic core members 102 and 104 are positioned within a coil housing 109, as shown in FIG. 4. The coil housing 109 is molded from a glass filled thermoplastic polyester resin. A potting material 107, such as a glass filled epoxy resin, is used to fill in the voids within the coil housing 109 and to hold the primary and secondary coil winding in the proper positions. This potting material 107 is shown partially removed in FIG. 4 for the purpose of illustration.

Electrical leads 110 and 112 are used to connect the ends of the primary winding 106 to primary terminals 114 and 116, which are supported by upper and lower portions of a molded plastic terminal block, designated respectively as 113*a* and 113*b*. The primary terminals 114 and 116 provide the external coil connection points for the primary winding 106. The ends of the secondary winding 122 are connected to external secondary terminals 124 and 126 in the standard fashion, such as illustrated by electrical leads 127 and 128 shown in FIG. 4.

The above described structure of the modified coil 100 is essentially identical with that of conventional direct ignition coils C1, C2, and C3, except for the reduced turns of the secondary winding 122 and segmented secondary bobbin 118. Reducing the turns of the secondary winding 122 increases the magnitude of the peak ignition current supplied by the modified coil 100, while use of the segmented secondary bobbin reduces the inter-winding capacitance of the secondary winding 122 to increase the peak voltage potential provided by the secondary winding 122.

Due to the reduced turns ratio and inter-winding capacitance of the secondary winding 122, a large reflected voltage potential can appear across the primary winding 106 in modified coil 100, when the secondary winding is disconnected from either of its associated spark plugs (known as the open circuit fault condition). This large primary voltage potential can damage the coil 100 or the semiconductor switch within the DIS ignition module 78 used to control current flow through the primary winding 106. To prevent this reflected potential from reaching a value that could cause damage, a metal oxide varistor 130 is connected in shunt with the primary winding 106 at the junction points 132 and 134 by welding or soldering. The metal oxide varistor 130 is a commercially available component, which is selected to break down at a predetermined potential (for example, 400 to 450 V), thereby limiting the reflected voltage potential across the primary winding and protecting its associated semiconductor switch, in the event that secondary winding 122 becomes open-circuited.

Figure 5:
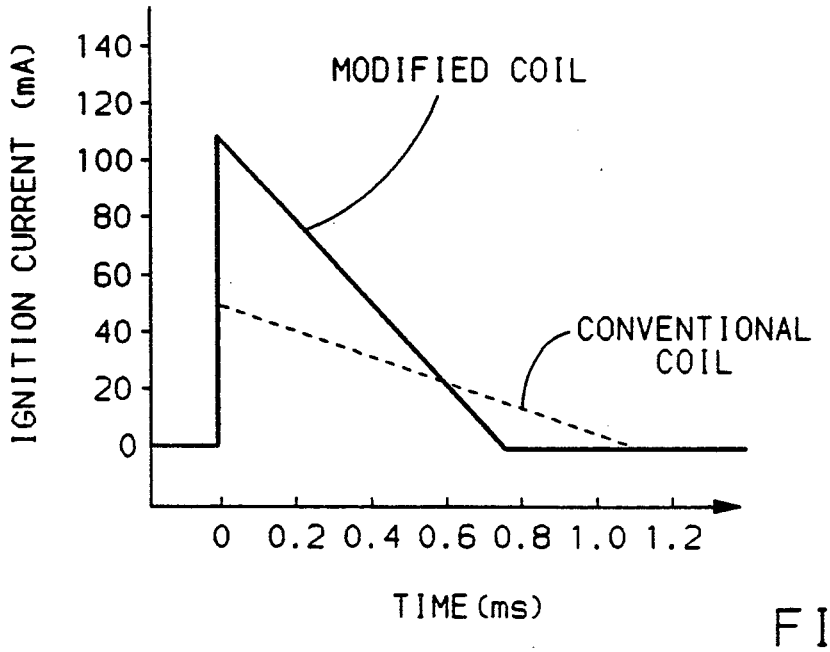
FIG. 5 provides a graphical representation comparing the ignition current supplied by the secondary winding of a conventional direct ignition coil and the ignition current supplied by the modified direct ignition coil employed in the preferred embodiment of the present invention.

FIG. 5 illustrates the difference between ignition current ignition current supplied by a convention DIS coil such as C1, C2, or C3, and the modified coil 100. Note that the modified coil 100 increases the peak ignition current to approximately 110 mA, as compared to the 50 to 60 mA supplied by the conventional coil design. To achieve the desired increase in the peak ignition current, the preferred embodiment utilizes the modified ignition coil 100, as described above, as a replacement for each of the conventional direct ignition coils C1, C2, and C3.

Once the peak ignition current is increased, the quantity of fuel delivered to the engine during cold starting can be increased to establish combustible cylinder fuel vapor-air mixtures at lower temperatures without producing engine misfiring. The Applicants have found that engine cold starting performance can be further improved by scheduling the delivering fuel in an optimized fashion as the engine is cranked for starting. According to this scheduling, a large initial quantity of fuel, which is sufficient to rapidly form a combustible fuel vapor-air mixture in each engine cylinder, is delivered as engine cranking commences. As cranking continues, the quantity of delivered fuel is progressively decreased to maintain combustible fuel vapor-air mixtures in the engine cylinders, while restricting the accumulation of unvaporized fuel in each cylinder so as not to exceed a predetermined amount.

This predetermined amount represents the maximum amount of unvaporized fuel that can accumulate in an engine cylinder without causing the cylinder spark plug to misfire due to wetting. Consequently, the predetermined amount of unvaporized fuel corresponds to the minimum resistive load that can appear in shunt with a spark plug arc gap, with the ignition current having a peak magnitude sufficient to achieve the break down voltage for the arc gap.

Figure 6:
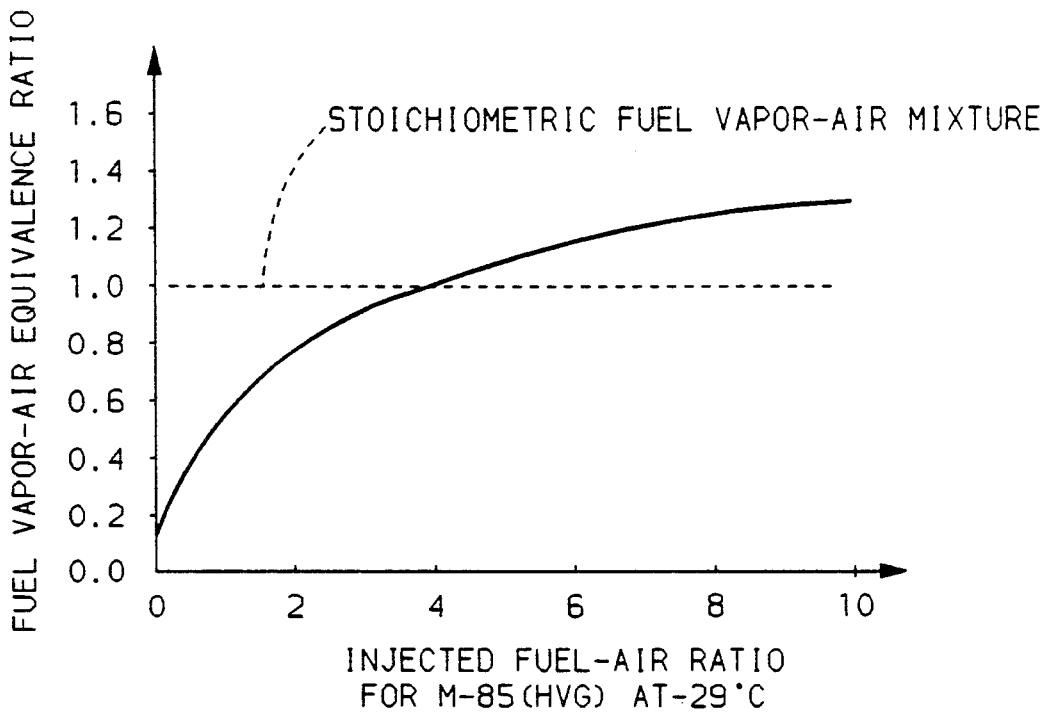
FIG. 6 provides a graphical representation of the computed fuel vapor-air equivalence ratio for M-85(HVG) methanol fuel as a function of the injected fuel-air ratio, at −29° C. and standard atmospheric pressure.

The procedure for determining the fueling schedule used in the preferred embodiment of the present invention will now be described. Referring to FIG. 6, there is shown a graph of the computed fuel vapor-air equivalence ratio as a function of the injected or delivered fuel-air ratio for M-85(HVG) alcohol-based fuel at a temperature of −29° C. and normal atmospheric pressure. Data for the plot was computed according to an equilibrium model used by the Applicants, and described more fully in a publication "Cold Starts Using M-85 (85% Methanol): Coping with Low Fuel Volatility and Spark Plug Wetting," C. J. Dasch, N. D. Brinkman, and D. H. Hopper, SAE Paper No. 910865, 1991.

The data in FIG. 6 indicates that an injected fuel-air ratio of approximately 4.0 is required to achieve a stoichiometric fuel vapor-air mixture for M-85(HVG) at the temperature of −29° C. with standard atmospheric pressure. This is approximately 30 times the mass of fuel that would be needed if all of the fuel were to vaporize, and about 10 times the mass of gasoline that would be needed to form a stoichiometric fuel vapor-air mixture at this temperature. Even though the temperatures and pressures in an engine cylinder are relatively higher than ambient, it has been found that the results predicted by the equilibrium model provide a reasonable estimate for the initial injected fuel-air ratio required to establish a combustible fuel vapor-air mixture in an engine cylinder.

It should also be noted that the equilibrium model as described in the above listed publication may be used to predict the fuel vapor-air equivalence ratio for an alcohol-based fuel other than M-85(HVG), given the composition of the fuel, the temperature, the pressure, and the injected air-fuel ratio.

Using the initial prediction for the fuel-air ratio required to form a combustible fuel vapor-air mixture for M-85(HVG) at −29° C. as a guide, experimental tests were conducted to determine how best to schedule the delivery of the fuel to an engine as it is cranked for starting. By varying the pulse width of the FUEL PULSE signals while cranking the engine for starting, it was found that a combustible fuel vapor-air mixture could be rapidly established in the engine cylinders by initially scheduling an injected fuel-air ratio which is increased slightly from that predicted by the model, and then decreasing the injected fuel-air ratio as a function of the number of revolutions that the engine is turned during cranking to prevent engine misfires.

By trial and error, the optimum rate for decreasing the injected fuel-air ratio was found to be approximately an exponential function of the cumulative number of cranking revolutions, and more specifically, a 20% reduction in the injected fuel-air ratio for every engine cycle (or every two revolutions of the crankshaft in a four-stroke engine). This optimum rate for decreasing the injected fuel-air ratio during cranking enabled the largest quantity of fuel to be delivered at the initiation of cranking, without producing subsequent engine misfires.

Figure 7:
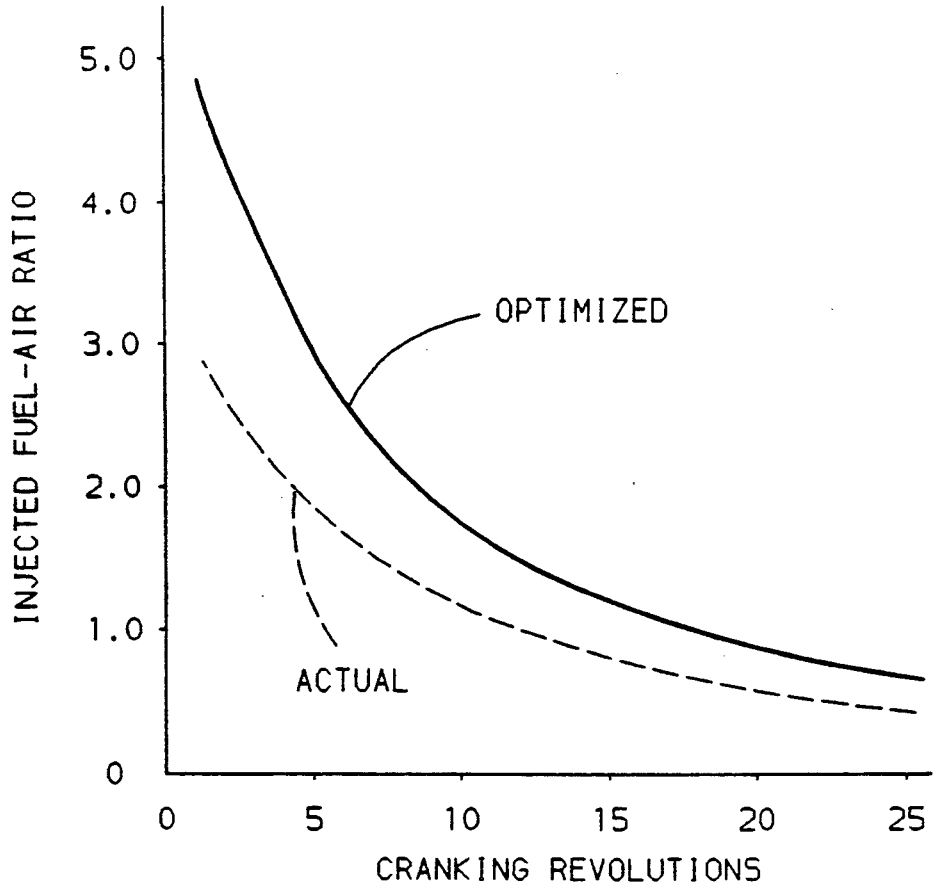
FIG. 7. provides a graphical representation comparing a typical optimized schedule for regulating the injected fuel-air ratio (assuming 100% volumetric efficiency) as a function of cranking revolutions, with the actual fuel-air ratio (assuming 100% volumetric efficiency) that was achieved in a practical implementation of the present invention.

FIG. 7 illustrates a graph of the empirically determined optimized fueling schedule (assuming 100% engine volumetric efficiency) for an engine operating on M-85(HVG) fuel at −29° C. and standard atmospheric pressure, when the engine is furnished with an ignition system capable of supplying each cylinder spark plug with a peak ignition current of approximately 100 mA. This fueling schedule provided the fastest cylinder first-firing during cranking, without overly wetting the spark plugs to cause subsequent rich misfires (i.e. reducing the resistive loading across the spark plug gaps to the point where the peak ignition current is no longer sufficient to achieve the break down voltage of the arc gaps). When starting the engine at higher temperatures, the scheduled initial fuel-air ratio decreases, but the exponential rate of decreasing the fuel-air ratio with cranking revolutions remains the same. It will be recognized by those skilled in the art that the optimum fueling schedules may change for different types of engines and/or different alcohol-based fuels, but these schedules can be empirically determined as set for above.

Consequently, the cold starting performance of an engine fueled with an alcohol-gasoline mixture can be enhanced in accordance with the present invention by: (1) deriving an indication of the engine temperature; (2) deriving an indication of the relative proportion of alcohol to gasoline in the fuel mixture; (3) deriving an indication of the cumulative number of engine revolutions during cranking; (4) delivering a scheduled quantity of fuel to the engine, as the engine is cranked for starting, where the scheduled quantity of fuel is determined as a function of the derived indications for the engine temperature, the relative proportion of alcohol to gasoline in the fuel mixture, and the cumulative number of cranking engine revolutions such that a combustible fuel vapor-air mixture is established in each engine cylinder, while the accumulation of unvaporized fuel in each cylinder is restricted so as not to exceed a predetermined amount; and (5) providing for each cylinder spark plug an ignition current having a magnitude sufficient to effectuate voltage break down across each spark plug arc gap, when the arc gap is resistively loaded due to wetting in accordance with the predetermined amount of accumulated unvaporized fuel.

Figure 8A:
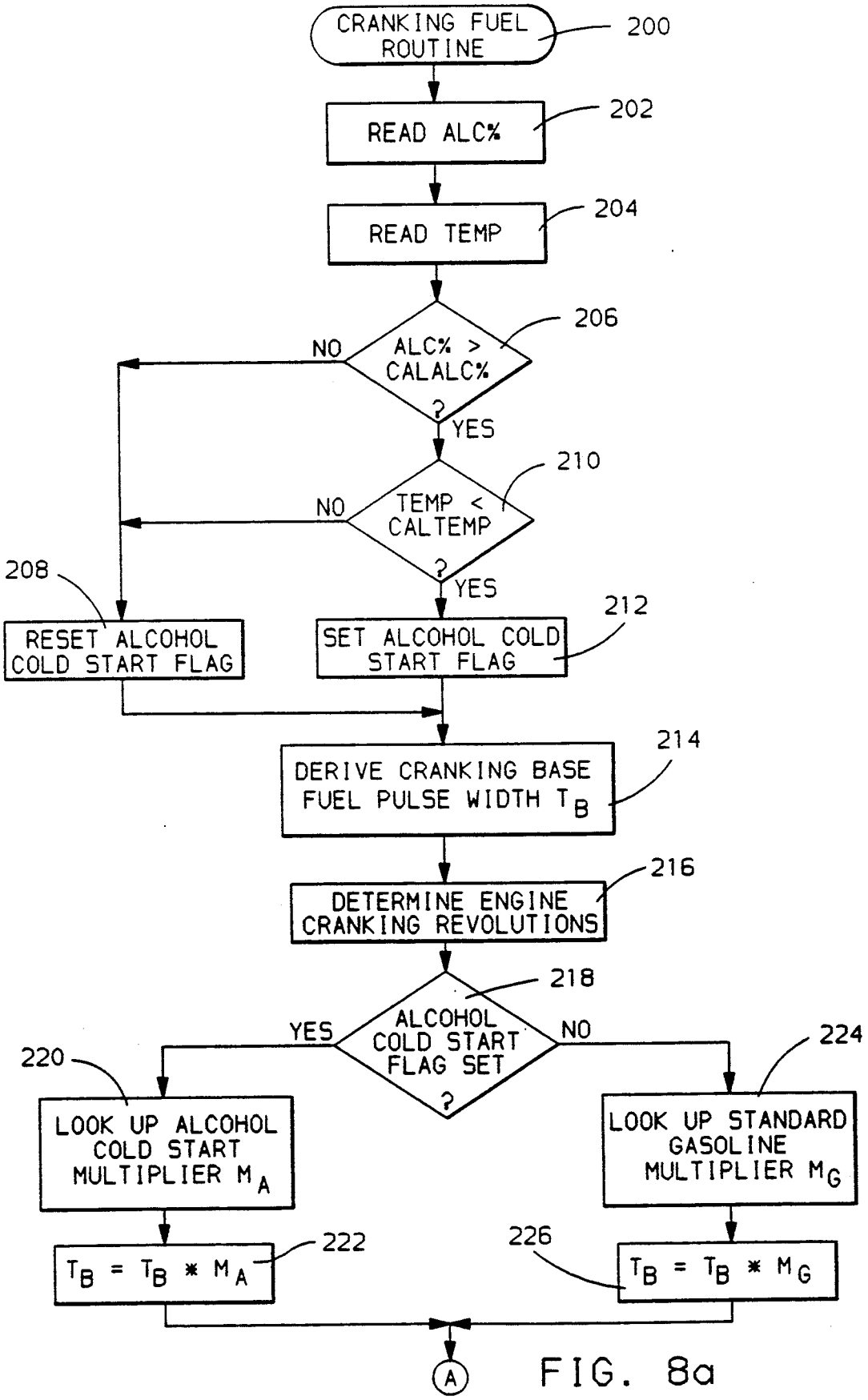
FIGS. 8A–B provide a flow diagram representative of the steps executed by the electronic control unit of FIG. 1, when scheduling the delivery of alcohol-based fuel during engine cold starting in accordance with the principles of the present invention.
Figure 8B:
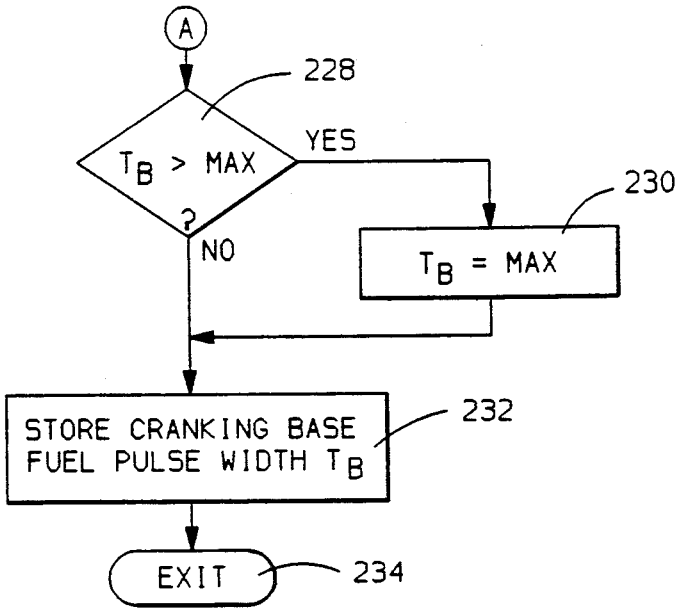

FIGS. 8A–B illustrate a simplified flow diagram representative of the steps executed by the electronic control unit 30 of FIG. 1, when scheduling the delivery of fuel to engine 10 during cold starting in accordance with the present invention. When the ignition switch 42 is rotated to start engine 10, the electronic control unit 30 is energized, and all of the internal counters, flags, registers, and timers are appropriately initialized. Thereafter, as is well known in the engine control art, the electronic control unit 30 continuously executes a main looped engine control program stored in read only memory. The CRANKING FUEL ROUTINE presented in FIGS. 8A–B is entered when engine 10 is cranked for starting, and is bypassed by the main engine control program, whenever the engine rotational speed exceeds a predetermined value (for example, 800 RPM), where the engine is considered to be running. The electronic control unit 30 determines the engine rotational speed from the REF input signal, as for example, by counting the number of pulses that occur during a fixed interval of time.

The CRANKING FUEL ROUTINE is entered at point 200 and passes to step 202, where the relative proportion of alcohol to gasoline in the fuel mixture is determined by reading the value of the fuel composition signal ALC % provided by the fuel composition sensor 34. Thereafter, routine proceeds to step 204.

At step 204, an indication of the engine temperature is derived by reading the value of the TEMP input signal provided by the engine coolant temperature sensor 32. The program then passes to step 206.

At step 206, a decision is made as to whether the relative proportion of alcohol to gasoline in the fuel mixture exceeds a predetermined percentage designated as CALALC % (for example, 71% methanol in a methanol-gasoline mixture). If ALC % is greater than CALALC %, the program proceeds to step 210, but if ALC % is not greater than CALALC %, the program passes to step When the program proceeds to step 210, a decision is made as to whether the value of TEMP is less than a predetermined value designated as CALTEMP (for example, −15° C., with a methanol-gasoline fuel mixture). If TEMP is less than CALTEMP, the program proceeds to step 212. If TEMP is not less than CALTEMP, the program passes to step 208.

When the program passes from step 210 to step 212, an ALCOHOL COLD START FLAG is set to indicate that conditions require that fuel be delivered to the engine in accordance with the principles of the present invention to assure cold starting of the engine (i.e. ALC % >71% and TEMP<−15° C.).

If the program passes to step 208 from either of steps 206 or 210, the ALCOHOL COLD START FLAG is reset to indicate that conditions do not exist for scheduling the delivery of fuel to the engine in accordance with the present invention.

Next at step 214, the base fuel pulse width $T_B$ for the engine fuel injectors (typically in units of milliseconds per engine revolution) is derived from a lookup table as a function of the engine temperature TEMP and the fuel composition ALC %. Other conventional corrections to the base fuel pulse width $T_B$, such as to account for deviations in barometric pressure, may also be made at this step in the routine. The lookup table values for $T_B$ are selected to provide the initial injected fuel-air ratio scheduled for the start of cranking as a function of the engine temperature TEMP and the fuel composition ALC %. For example, if the engine temperature TEMP=−29° C. and ALC % =85, then ideally the corresponding value for the fuel pulse width would be selected to provide the engine with an initial injected fuel-air ratio of approximately 5.0, as indicated by the optimized schedule shown in FIG. 7.

From step 214, the program proceeds to step 16, where the cumulative number of complete engine revolutions since the start of cranking, (hereinafter referred to as cranking revolutions) is determined. This may be accomplished within the ECU 30 by counting the the total number of pulses in the REF signal that occur after the initiation of cranking, and dividing that total by the number of reference pulses occurring during a single revolution of the engine crankshaft (three in this case).

Next at step 218, a decision is required as to whether the ALCOHOL COLD START FLAG has been set or reset. If the ALCOHOL COLD START FLAG is set, the program proceeds to step 220, where a value for an alcohol cold start multiplier $M_A$ is obtained from a lookup table based upon the number of cranking revolutions determined at step 216. Next at step 222, a new value for the base fuel pulse width is obtained by multiplying the current value of $T_B$ by the alcohol cold start multiplier $M_A$.

Returning to step 218, if the ALCOHOL COLD START FLAG is not set, or has been reset, the routine proceeds to step 224, where a value for a standard gasoline multiplier $M_G$ is obtained from a different lookup table, again based upon the number of cranking revolutions. Then at the next step 226, the current value for the base fuel pulse width $T_B$ is multiplied by the value of $M_G$ to obtain the new value for $T_B$ Once the new value for the fuel pulse width $T_B$ is determined at either step 222 or 224, the program proceeds to step 228.

At step 228, the current value of the fuel pulse width is examined to determine whether it exceeds a maximum allowable value MAX. If $T_B$ is greater than MAX at step 228, the program proceeds to step 230, where $T_B$ is set equal to the value of MAX, before passing to step 232. If TB is not greater than MAX at step 228, the program proceeds directly to step 232, without passing through step 230. The value of MAX represents the practical upper limit of time available for injection per engine revolution (approximately 512 milliseconds for the engine 10 in the present embodiment).

At the next step 232, the current value for the fuel pulse width $T_B$ is stored in the random access memory of ECU 30, and is used in the main looped control program for setting the pulse width of the FUEL PULSE signal directed to each engine fuel injector. Once step 232 is completed, the routine is exited at point 234.

Figure 9:
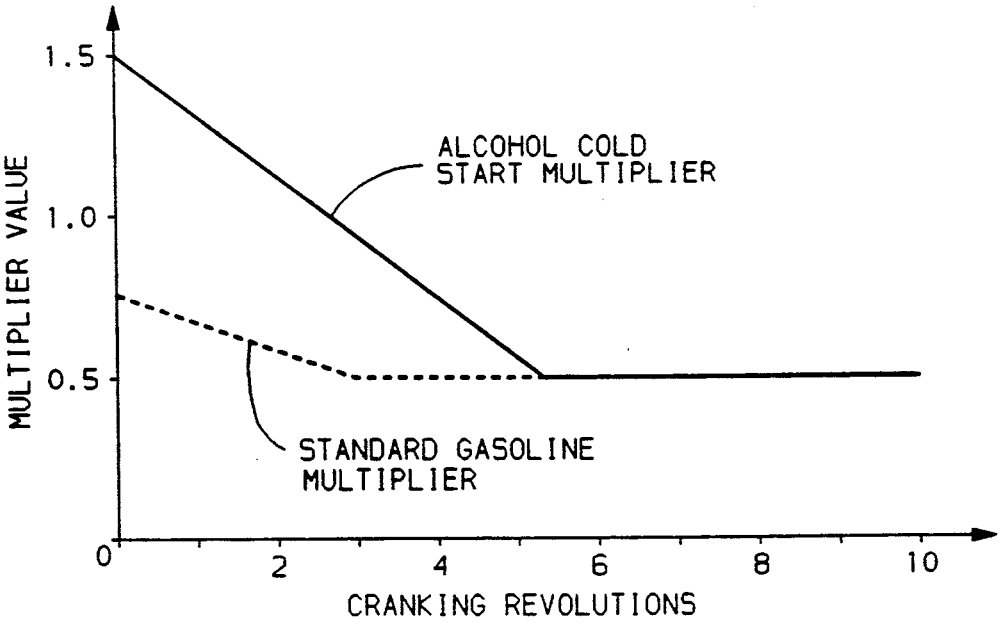
FIG. 9 provides a graphical representation of typical values for standard gasoline and alcohol cold start multipliers used for scheduling the delivery of a methanol-gasoline fuel mixture during engine cranking for cold starting.

Typical values for the lookup tables containing the standard gasoline and alcohol cold start multipliers as a function of cranking revolutions are graphically illustrated in FIG. 9. The values for the standard gasoline multiplier $M_G$ are those conventionally used for starting engine 10. The values for the alcohol cold start multiplier $M_A$ are selected to approximately achieve the optimum rate of decrease in fuel delivery, in accordance with the present invention, as the engine is cranked for starting. Note that although the quantity of air delivered to the engine is relatively constant during cranking, the cold start multiplier does not decrease at the optimized exponential rate of 20% for every cycle of the engine. This is because the multiplier has been adjusted to account for the reduction in fuel flow from an electric fuel pump (not shown), which delivers the fuel to the engine fuel injectors. This reduction in fuel pump flow results as the battery voltage drops during engine cranking. This effect was eliminated when determining the optimized fuel-air ratio schedule for a particular starting temperature (see FIG. 7) by utilizing a high capacity electric fuel pump for supplying fuel to the test engine and ensuring that the constant voltage was applied to drive the fuel pump.

Shown in FIG. 7 is a plot of the actual injected fuel-air ratio (at −29° C.) that was achieved in a production six-cylinder, 3.1 liter engine having the above described embodiment of the present invention, for comparison with the optimized schedule for the injected fuel-air ratio. Note that although it was possible to substantially achieve the optimum rate of decrease for the actual injected fuel-air ratio (20% per two cranking revolutions) in the production engine, it was not possible to attain the called for initial fuel-air ratio of approximately 5.0 at the start of cranking. This was due to the drop in battery voltage with engine cranking and the limited capacity of the particular electric fuel pump employed in the production engine As a result, the cold starting performance of the production engine was significantly improved, but testing indicated that it could not be consistently started at ambient temperatures below −23° C.

Further tests using four-cylinder and six-cylinder engines fueled with M-85(HVG) have demonstrated that successful cold starting can be consistently achieved at −29° C., in less than 10 seconds after the initiation of cranking, when the engines are provided with a sufficient flow of fuel to realize the optimized schedule for the injected fuel-air ratio during cranking. This was accomplished by employing standard high capacity electric fuel pumps and voltage regulators for maintaining constant fuel pump driving voltages during cranking.

In the above described embodiment of the invention, a fuel composition sensor 34 was utilized to provide information related to the composition of the alcohol-based fuel delivered to engine 10. If the composition of the alcohol-based fuel is known and remains fixed for the engine, then the fuel composition sensor would not be required. In this case, steps 202 and 206 of the CRANKING FUEL ROUTINE of FIG. 8A could be removed, and the value for the base fuel pulse width $T_B$ (found at step 214) could be looked up as a function of engine temperature alone, since the fuel composition would remain fixed.

It will also be recognized by those skilled in the automotive art that the present invention is applicable to engines having ignition systems with distributors. Such a system would require only a single ignition coil having the above described modifications for increasing the peak ignition current. As is well known, one end of the secondary winding of the modified coil would be connected to the distributor rotor with the other end of the secondary winding connected to a ground point on the vehicle.

Thus, the aforementioned description of the preferred embodiments of the invention is for the purpose of illustrating the invention, and is not to be considered as limiting or restricting the invention, since many modifications may be made by the exercise of skill in the art without departing from the scope of the invention.

The embodiments of the invention in which an exclusive property or privilege is claimed are defined as follows:

1. A method for enhancing the cold-starting capability of an internal combustion engine operating on an alcohol-based fuel mixture, the engine including a cranking means for rotating the engine during starting, a means for delivering the fuel mixture to each engine cylinder, and a spark plug with an arc gap positioned in each engine cylinder for igniting the delivered fuel mixture, the steps of the method comprising:

regulating the quantity of alcohol-based fuel delivered to the engine during cranking to establish a combustible fuel vapor-air mixture in each engine cylinder, while restricting the accumulation of unvaporized fuel in each engine cylinder so as not to exceed a predetermined amount; and providing to each cylinder spark plug an ignition current having a peak magnitude sufficient to effectuate voltage break down across each spark plug arc gap, when each arc gap is resistively loaded due to wetting in accordance with the predetermined amount of accumulated unvaporized fuel.

2. The method as described in claim 1, wherein the magnitude of the peak ignition current provided to each cylinder spark plug is greater than 60 mA.

3. The method as described in claim 1, wherein the magnitude of the peak ignition current provided to each cylinder spark plug is greater than 100 mA.

4. The method as described in claim 1, wherein the quantity of alcohol-based fuel delivered to the engine is reduced during cranking to effectuate a delivered fuel-air ratio that decreases at a substantially exponential rate as a function of the cumulative number revolutions that the engine is rotated during cranking.

5. A method for enhancing the cold-starting capability of an internal combustion engine operating on an alcohol-based fuel mixture, the engine including a cranking means for rotating the engine during starting, a means for delivering the fuel mixture to each engine cylinder, and a spark plug with an arc gap positioned in each engine cylinder for igniting the delivered fuel mixture, the steps of the method comprising:

deriving an indication of engine temperature as the engine is cranked for starting;

regulating the quantity of alcohol-based fuel mixture delivered to the engine during cranking, to establish a combustible fuel vapor-air mixture in each engine cylinder at the indicated engine temperature, while restricting the accumulation of unvaporized fuel in each cylinder so as not to exceed a predetermined amount; and providing each cylinder spark plug with an ignition current having a magnitude sufficient to effectuate voltage break down across each sprak plug arc gap, when each spark plug arc gap is resistively loaded due to wetting in accordance with the predetermined amount of accumulated unvaporized fuel.

6. A method for enhancing the cold-starting capability of an internal combustion engine operating on an alcohol-gasoline fuel mixture, the engine including a cranking means for rotating the engine during starting, a means for delivering the fuel mixture to each engine cylinder, and a spark plug with an arc gap positioned in each engine cylinder for igniting the delivered fuel mixture, the steps of the method comprising:

deriving an indication of the engine temperature;

deriving an indication of the relative proportion of alcohol to gasoline in the fuel mixture;

deriving an indication of the cumulative number of engine revolutions during cranking;

delivering a scheduled quantity of fuel to the engine, as the engine is cranked for starting, where the scheduled quantity of fuel is determined as a function of the derived indications for the engine temperature, the relative proportion of alcohol to gasoline in the fuel mixture, and the cumulative number of cranking engine revolutions, so that a combustible fuel vapor-air mixture is established in each engine cylinder, while restricting the accumulation of unvaporized fuel in each cylinder so as not to a predetermined amount; and providing for each cylinder spark plug an ignition current having a magnitude sufficient to effectuate voltage break down across each spark plug arc gap, when each arc gap is resistively loaded due to wetting in accordance with the predetermined amount of accumulated unvaporized fuel.

7. The method as described in claim 6, wherein the quantity of fuel initially delivered to the engine at the initiation of cranking is determined as a function of the derived indications for the engine temperature and the relative proportion of alcohol to gasoline in the fuel mixture, and thereafter, the quantity of delivered fuel is reduced during cranking to effectuate a delivered fuel-air ratio that decreases at a substantially exponential rate as a function of the cumulative number of revolutions that the engine is rotated during cranking.

8. The method as described in claim 7, wherein the delivered fuel-air ratio is decreased at the exponential rate of approximately 20% for every two cranking revolutions of the engine.

9. A method for cold-starting an internal combustion engine operating on an methanol-gasoline fuel mixture at ambient temperatures below −20° C., the engine including a cranking means for rotating the engine during starting, a means for delivering the fuel mixture to each engine cylinder, and a spark plug with an arc gap positioned in each engine cylinder for igniting the delivered fuel mixture, the steps of the method comprising:

regulating the quantity of the methanol-gasoline fuel mixture delivered to the engine during cranking, to establish a combustible fuel vapor-air mixture in each engine cylinder, while restricting the accumulation of unvaporized fuel in each engine cylinder so as not to exceed a predetermined amount; and providing to each cylinder spark plug an ignition current having a peak magnitude sufficient to effectuate voltage break down across each spark plug arc gap, when each arc gap is resistively loaded due to wetting in accordance with the predetermined amount of accumulated unvaporized fuel.

10. An apparatus for enhancing the cold-starting capability of an internal combustion engine operating on an alcohol-based fuel mixture, the engine including a cranking means for rotating the engine during starting, a means for delivering the fuel mixture to each engine cylinder, and a spark plug with an arc gap positioned in each engine cylinder for igniting the delivered fuel mixture, the apparatus comprising:

means for regulating the quantity of alcohol-based fuel delivered to the engine during cranking to establish a combustible fuel vapor-air mixture in each engine cylinder, while restricting the accumulation of unvaporized fuel in each engine cylinder so as not to exceed a predetermined amount; and means for providing to each cylinder spark plug an ignition current having a peak magnitude sufficient to effectuate voltage break down across each spark plug arc gap, when each arc gap is resistively loaded due to wetting in accordance with the predetermined amount of accumulated unvaporized fuel.

11. The apparatus as described in claim 10, wherein the magnitude of the peak ignition current provided to each cylinder spark plug is greater than 60 mA.

12. The apparatus as described in claim 10, wherein the magnitude of the peak ignition current provided to each cylinder spark plug is greater than 100 mA.

13. The apparatus as described in claim 10, wherein the quantity of alcohol-based fuel mixture delivered to the engine is reduced during cranking to effectuate a delivered fuel-air ratio that decreases at a substantially exponential rate as a function of the the cumulative number of cranking revolutions of the engine.

14. The apparatus as described in claim 10, wherein the means for providing each cylinder spark plug with an ignition current comprises an ignition system including inductive and capacitive discharge portions.

15. The apparatus as described in claim 10, wherein the means for providing each cylinder spark plug with an ignition current further includes at least one ignition coil having a secondary to primary winding turns ratio in the order of 65:1.

16. The apparatus as described in claim 15, wherein the the secondary winding of the ignition coil is wrapped onto a segmented dielectric bobbin having a plurality of partitions for separating adjacent portions of the secondary winding to reduce its electrical inter-winding capacitance.

17. An apparatus for enhancing the cold-starting capability of an internal combustion engine operating on an alcohol-based fuel mixture, the engine including a cranking means for rotating the engine during starting, a means for delivering the fuel mixture to each engine cylinder, and a spark plug with an arc gap positioned in each engine cylinder for igniting the delivered fuel mixture, the apparatus comprising:

means for deriving an indication of engine temperature as the engine is cranked for starting;

means for regulating the quantity of alcohol-based fuel mixture delivered to the engine during cranking, to establish a combustible fuel vapor-air mixture in each engine cylinder at the indicated engine temperature, while restricting the accumulation of unvaporized fuel in each cylinder so as not to exceed a predetermined amount; and means for providing each cylinder spark plug with an ignition current having a magnitude sufficient to effectuate voltage break down across each spark plug arc gap, when each spark plug arc gap is resistively loaded due to wetting in accordance with the predetermined amount of accumulated unvaporized fuel.

18. An apparatus for enhancing the cold-starting capability of an internal combustion engine operating on an alcohol-gasoline fuel mixture, the engine including a cranking means for rotating the engine during starting, a means for delivering the fuel mixture to each engine cylinder, and a spark plug with an arc gap positioned in each engine cylinder for igniting the delivered fuel mixture, the apparatus comprising:

means for deriving an indication of the engine temperature;

means for deriving an indication of the relative proportion of alcohol to gasoline in the fuel mixture;

means for deriving an indication of the cumulative number of engine revolutions during cranking;

means for delivering a scheduled quantity of fuel mixture to the engine, as the engine is cranked for starting, where the scheduled quantity of fuel is determined as a function of the derived indications for the engine temperature, the relative proportion of alcohol to gasoline in the fuel mixture, and the cumulative number of cranking engine revolutions, such that a combustible fuel vapor-air mixture is established in each engine cylinder, while restricting the accumulation of unvaporized liquid fuel in each engine cylinder so as not to exceed a predetermined amount; and means for providing for each cylinder spark plug an ignition current having a magnitude sufficient to effectuate voltage break down across each spark plug arc gap, when the arc gap is resistively loaded due to wetting in accordance with the predetermined amount of accumulated unvaporized fuel.

19. The apparatus as described in claim 16, wherein the quantity of fuel initially delivered to the engine at the initiation of cranking is determined as a function of the derived indications for the engine temperature and the relative proportion of alcohol to gasoline in the fuel mixture, and thereafter, the quantity of delivered fuel is reduced during cranking to effectuate a delivered fuel-air ratio that decreases at a substantially exponential rate as a function of the cumulative number of cranking revolutions of the engine.

20. The apparatus as described in claim 16, wherein the delivered fuel-air ratio is decreased at the exponential rate of approximately 20% for every additional two cranking revolutions of the engine.

21. An apparatus for cold-starting an internal combustion engine operating on an methanol-gasoline fuel mixture at ambient temperatures below −20° C., the engine including a cranking means for rotating the engine during starting, a means for delivering the fuel mixture to each engine cylinder, and a spark plug with an arc gap positioned in each engine cylinder for igniting the delivered fuel mixture, the apparatus comprising:

means for regulating the quantity of methanol-gasoline fuel mixture delivered to the engine during cranking to establish a combustible fuel vapor-air mixture in each engine cylinder, while restricting the accumulation of unvaporized fuel in each cylinder so as not to exceed a predetermined amount; and means for providing to each cylinder spark plug an ignition current having a peak magnitude sufficient to effectuate voltage break down across each spark plug arc gap, when each arc gap is resistively loaded due to wetting in accordance with the predetermined amount of accumulated unvaporized fuel.

* * * * *